US005577951A

United States Patent [19]

Jabcon, Jr.

[11] Patent Number: 5,577,951

[45] Date of Patent: Nov. 26, 1996

[54] PROCESS AND APPARATUS FOR ABRADING EXTRUSIONS

[75] Inventor: Leonard J. Jabcon, Jr., Charleston Township, Kalamazoo County, Mich.

[73] Assignee: Azon USA, Inc., Kalamazoo, Mich.

[21] Appl. No.: 96,695

[22] Filed: Jul. 23, 1993

[51] Int. Cl.[6] ..... B24B 7/19

[52] U.S. Cl. ..... 451/51; 451/167; 451/182

[58] Field of Search ..... 451/51, 61, 54, 451/55, 57, 58, 119, 182, 120, 121, 124, 162, 163, 164, 167, 178

[56] References Cited

U.S. PATENT DOCUMENTS

| | | | |
|---|---|---|---|
| 420,658 | 2/1890 | Hayes . | |
| 607,071 | 7/1898 | Ohl . | |
| 1,444,376 | 2/1923 | Guyse et al. . | |
| 1,927,476 | 9/1933 | Walker et al. | 451/162 |
| 2,949,707 | 8/1960 | Staelin | 451/164 |
| 3,204,324 | 9/1965 | Nilsen . | |
| 3,641,710 | 2/1972 | Heinelt | 451/211 |
| 3,754,354 | 8/1973 | Franlinna | 451/167 |
| 4,096,678 | 6/1978 | Diels et al. . | |
| 4,128,934 | 12/1978 | Doring . | |
| 4,179,850 | 12/1979 | Gillette | 451/164 |
| 4,619,097 | 10/1986 | Trummer et al. . | |
| 4,646,479 | 3/1987 | Walker et al. | 451/466 |

FOREIGN PATENT DOCUMENTS

| | | |
|---|---|---|
| 2709786 | 6/1978 | Germany . |
| 2008655 | 6/1979 | United Kingdom . |

OTHER PUBLICATIONS

Sketch of Prior Art Machine for Mechanically Abrading Extrusions.

*Primary Examiner*—Timothy V. Eley

*Attorney, Agent, or Firm*—Flynn, Thiel, Boutell & Tanis, P.C.

[57] ABSTRACT

A combination of an apparatus or an extrusion for lengthwise movement of the elongate metal extrusion. The extrusion having therein a lengthwise cavity which has a central portion and two pockets disposed on opposite sides of and opening into the central portion. The apparatus has a tool disposed in the cavity and supported for eccentric rotation about an axis extending perpendicular to the direction of movement of the extrusion, the tool having abrading points which are spaced angularly about its centerline and which engage and physically roughen a surface in one of the pockets. The degree of eccentricity is adjustable. In a variation, the apparatus effects movement of a first member having two pegs which engage angled slots in a second member supporting a tool in the extrusion cavity, the tool being moved rectilinearly into and out of engagement with the extrusion surface in a manner physically roughening the surface.

23 Claims, 11 Drawing Sheets

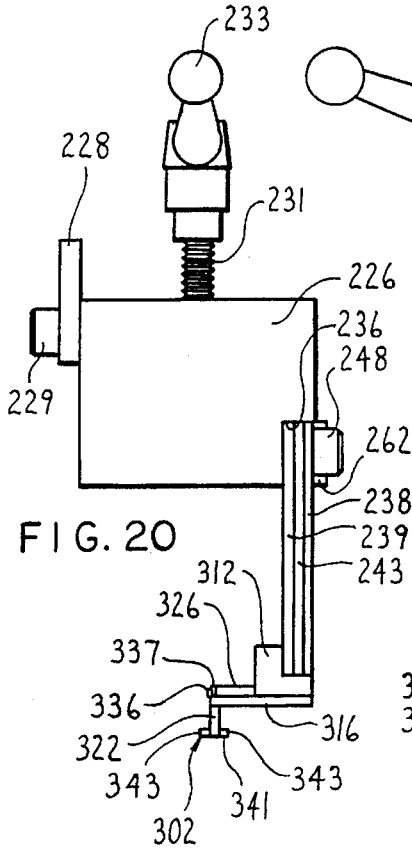
FIG. 20
FIG. 19
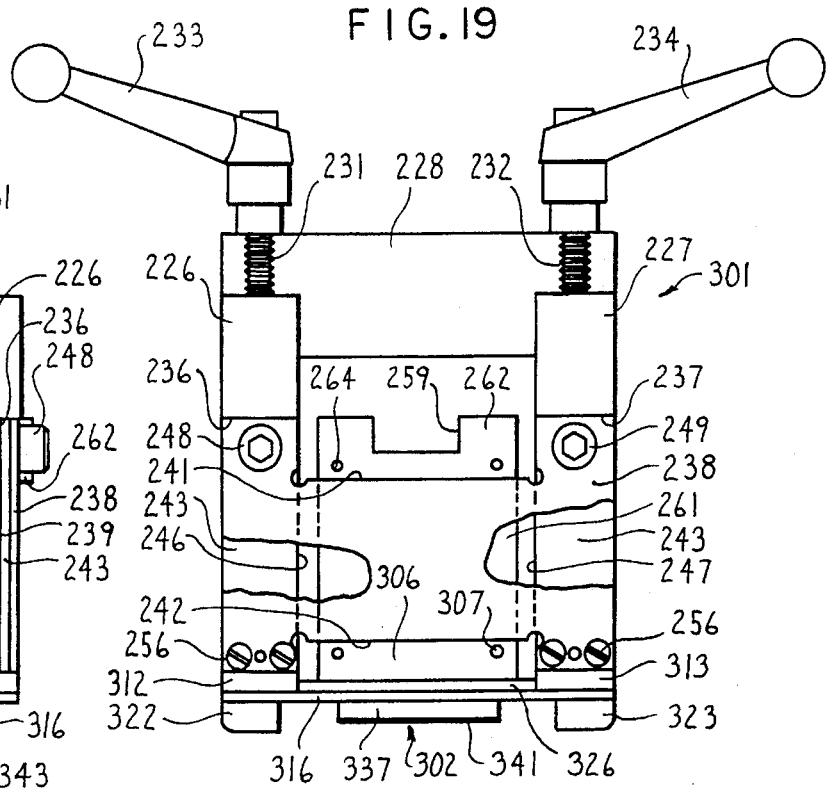
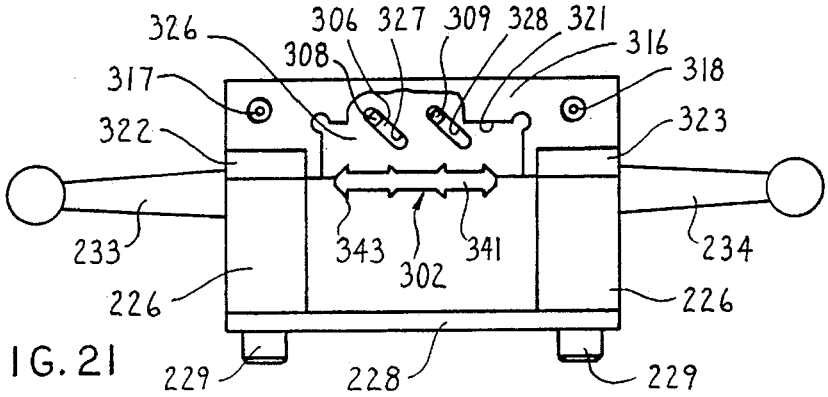
FIG. 21

PROCESS AND APPARATUS FOR ABRADING EXTRUSIONS

FIELD OF THE INVENTION

This invention relates generally to thermal break construction components having two metal parts connected by an insulating material and, more specifically, to an improved method and apparatus for preventing lengthwise shrinkage of the insulating material relative to the metal parts.

BACKGROUND OF THE INVENTION

For many years, window and door frames were made from aluminum extrusions, which of course were highly durable. However, there were some associated problems. First, aluminum is an excellent thermal conductor, and the ability of these frames to rapidly transfer heat from the interior of a building to the exterior presented a problem as concerns about energy conservation have increased. Further, when the ambient exterior temperature is cold, condensation tends to form on the interior side of the frame, and this moisture has a tendency to run onto and damage painted surfaces, carpeting and the like.

Accordingly, an alternative approach was developed, in which two aluminum parts serving as the interior and exterior portions of the frame are connected only by an insulating material with a very low coefficient of thermal conductivity. A conventional and common manufacturing process for making such an arrangement is to first produce a single aluminum extrusion having a pair of C-shaped portions which are spaced from each other and define respective pockets that open toward each other, and having a bridge portion extending horizontally from one C-shaped portion to the other. A liquid plastic material is then poured into a region between the C-shaped portions so that it fills the region between them and also fills the pockets, the bridge portion holding the liquid plastic in place until it has hardened. After the plastic has hardened, the bridge portion is mechanically ground away with a grinding wheel or the like, leaving two separate extrusion parts which do not directly contact each other but are rigidly interconnected by the hardened plastic. This conventional approach is very successful in solving the traditional problem discussed in the preceding paragraph. However, another problem unique to this approach has developed.

More specifically, because the aluminum frame parts and the plastic material have different coefficients of thermal expansion, the plastic and aluminum tend to shift in a lengthwise direction with respect to each other over time. In fact, the plastic frequently has a tendency to shrink in overall length as this occurs, which is commonly referred to as dry shrinkage. The result of dry shrinkage is gaps between the aluminum extrusions just beyond the ends of the plastic material, through which rain or other moisture can enter the structure of a wall or floor supporting the window or door, with resulting water damage. Attempts have been made to chemically alter the formulation of the plastic so that it bonds more securely to the surfaces of the aluminum and so that it has little or no tendency toward dry shrinkage in length. To date, however, it has not been possible to chemically formulate a plastic which bonds tightly to the surface of an aluminum extrusion, no matter how thoroughly the surface has been cleaned, or a plastic which is satisfactorily free of dry shrinkage in overall length.

Therefore, although research for a chemical solution continues, attempts have also been made to mechanically resolve the problem, for example by mechanically interconnecting the plastic material to the extrusions in a manner effectively preventing relative movement. Mechanical approaches have included use of cooperating tabs and recesses on the plastic material and extrusions, and sandblasting of extrusion surfaces to roughen them so the plastic can achieve a strong bond. However, cooperating tabs and recesses are not very practical or efficient from a mass production viewpoint, and sandblasting an extrusion surface does not necessarily produce sufficient roughness to facilitate a particularly strong bond to the plastic, and is messy and inefficient from a production viewpoint. Accordingly, one object of the present invention is to provide an improved method and apparatus for mechanically roughening a surface of an extrusion so that, after a plastic material has been applied thereto in liquid form and hardens, the mechanical roughness is sufficient to reliably resist significant lengthwise movement of the plastic relative to the extrusion surface.

SUMMARY OF THE INVENTION

The objects and purposes of the invention, including those set forth above, are met according to one form of the invention by providing a method and apparatus which involve: an elongate extrusion having a central axis extending lengthwise thereof and having a surface extending therealong parallel to the central axis; a tool disposed adjacent the surface and having a centerline which extends approximately perpendicular to the central axis; the extrusion being moved lengthwise relative to the tool in a direction parallel to the central axis; and the tool being rotated about an axis of rotation which extends approximately parallel to and is spaced radially from the centerline, the tool having structure thereon for engaging and physically roughening the surface on the extrusion as the extrusion moves past the tool during rotation of the tool about the axis of rotation.

Another form of the present invention involves: an elongate extrusion having a central axis extending lengthwise thereof and having a lengthwise cavity with a surface extending parallel to the central axis; a tool disposed in the cavity adjacent the surface; an arrangement for effecting lengthwise movement of the extrusion relative to the tool in a direction parallel to the central axis; and an arrangement for reciprocating the tool substantially rectilinearly within the cavity between positions engaging and spaced from the surface during the movement of the extrusion relative to the tool, the tool having structure thereon for physically roughening the surface on the extrusion when the tool engages the surface.

Yet another form of the present invention involves: an elongate extrusion having a central axis extending lengthwise thereof and having a lengthwise cavity with a cross-sectional shape which includes a central portion, first and second pockets disposed on opposite sides of the central portion, and elongate slots which each provide communication between the central portion and a respective one of the pockets, the first pocket having therein a surface which extends lengthwise of the extrusion; a tool disposed in the cavity and extending from the central portion through one of the slots into the first of the pockets; an arrangement for effecting lengthwise movement of the extrusion relative to the tool in a direction parallel to the central axis; and an arrangement for effecting movement of the tool, the tool having structure thereon for engaging and physically roughening the surface as the extrusion moves past the tool during movement of the tool.

BRIEF DESCRIPTION OF THE DRAWINGS

Preferred embodiments of the invention are described in detail hereinafter with reference to the accompanying drawings, in which:

FIG. 19 is a fragmentary rear view of an alternative embodiment of the tool support assembly of FIG. 12; FIG. 20 is a side view of the tool support assembly of FIG. 19; FIG. 21 is a fragmentary bottom view of the tool support assembly of FIG. 19.

DETAILED DESCRIPTION

Figure 1:
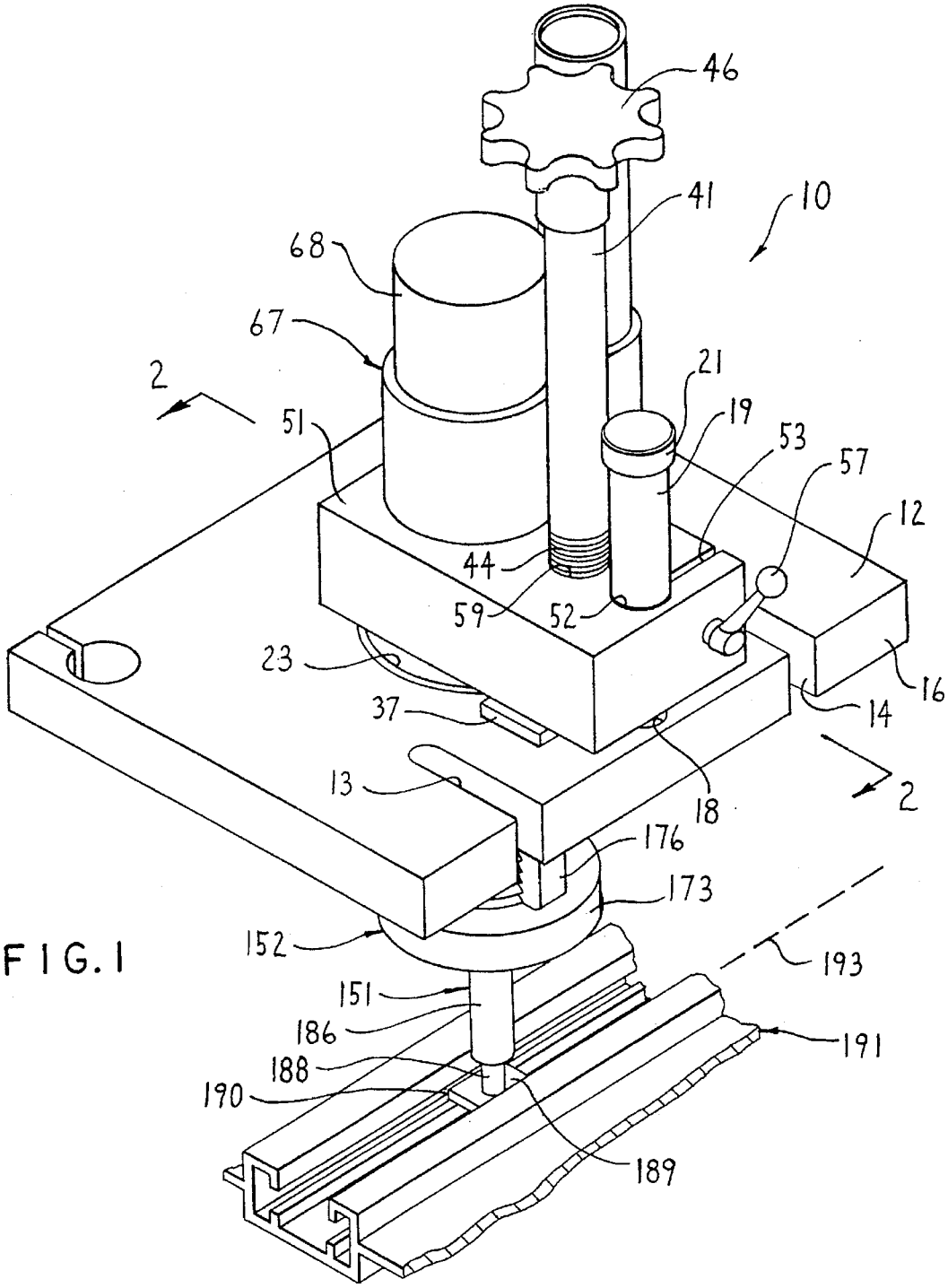
FIG. 1 is a fragmentary perspective view of part of an extrusion abrading machine which embodies the present invention, and of an extrusion which is being abraded by the machine.
Figure 2:
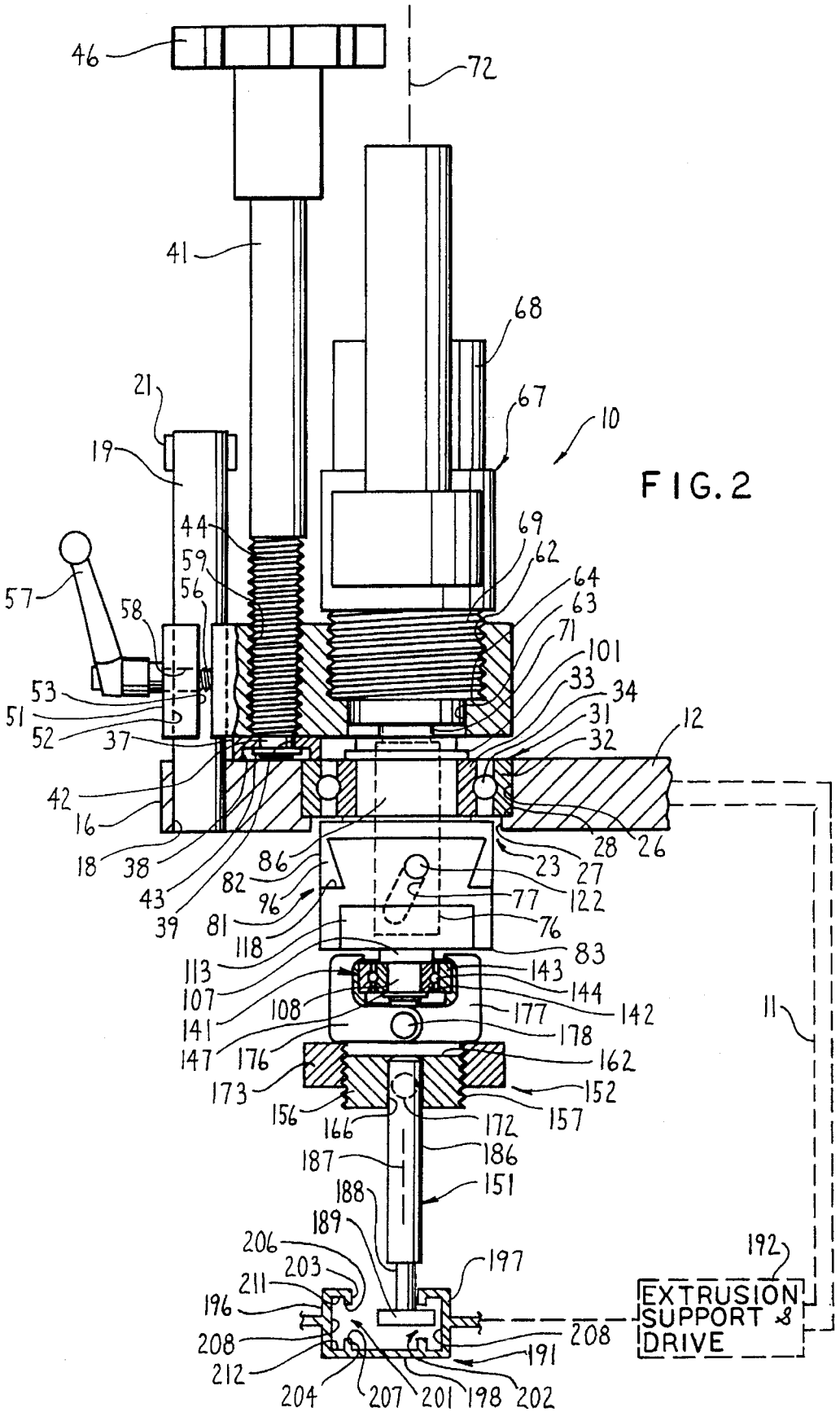
FIG. 2 is a sectional view taken along the line 2—2 in FIG. 1.

Referring to FIGS. 1 and 2, reference numeral 10 denotes an extrusion abrading machine which embodies the present invention. The machine 10 includes a frame which is shown diagrammatically at 11 in FIG. 2, and which supports a stationary and horizontally extending base plate 12.

The base plate 12 has two spaced and parallel slots 13 and 14 which open vertically through it and which extend inwardly from spaced locations along an outer edge 16 of the base plate 12. The base plate 12 has near the end 16, at a location intermediate the slots 13 and 14, a vertical bore 18 which fixedly receives the lower end of a cylindrical guide pin 19. The guide pin 19 can be welded to the plate 12, or alternatively the bore 18 and the lower end of guide pin 19 could have cooperating threads. The guide pin 19 has at its upper end a head portion 21 of greater diameter than the rest of the pin.

As best seen in FIG. 2, the base plate 12 also has a stepped circular opening 23 extending vertically through it, the opening 23 having an upper portion 26 and having a lower portion 27 of smaller diameter than the upper portion 26, so that an annular step 28 is defined between the upper and lower portions 26 and 27. A conventional ball bearing 31 is disposed in the opening 23, the ball bearing 31 having an outer race 32, an inner race 33, and a plurality of balls 34 disposed between the races 32 and 33. The outer race 32 is disposed in the upper portion 26 of the opening 23 with a force fit, and has its lower end disposed against the annular step 28. A rectangular metal retainer plate 37 is disposed against the top surface of base plate 12 between the bore 18 and opening 23, and is fixedly removably secured to the plate 12 by two screws which are not illustrated. An edge portion of the plate 37 extends over a peripheral edge portion of the outer race 32 of bearing 31 (FIG. 2), in order to help maintain the bearing in place. The retainer plate 37 has in its underside a shallow recess 38, and a cylindrical opening 39 opens vertically through the plate from the shallow recess 38 to the upper side of the plate.

A vertical adjustment shaft 41 has near its lower end a neck 42 of reduced diameter which is rotatably disposed in the opening 39, and a snap ring 43 is disposed on the lower end of the shaft 41 within the recess 38 of plate 37 so that the shaft 41 is rotatably supported by the retainer plate 37. A portion 44 of the shaft 41 just above the neck 42 is threaded, and the shaft 41 has at its upper end a knob 46 which can be used to manually rotate the shaft 41.

A motor support plate 51 has extending through it a cylindrical hole 52 which has a slightly larger diameter than and which slidably receives the guide pin 19, and also has a slot 53 which opens vertically through the plate 51 and extends from one edge of the plate 51 to the cylindrical hole 52. A bolt 56 has a head with an outwardly extending wing 57, and a threaded shank which extends through a horizontal hole 58 on one side of the slot 53 and threadedly engages a threaded hole (not illustrated) on the opposite side of the slot 53. Thus, when the bolt 56 is loosened, the motor support plate 51 can slide vertically on the guide pin 19, whereas when the bolt 56 is manually tightened, the bolt 56 reduces the width of the slot 56 so that the guide pin 19 is tightly clamped within the cylindrical hole 52 and the plate 51 is held against vertical movement.

Near the hole 58, the motor support plate 51 has a threaded bore 59 which receives and threadedly engages the threaded portion 44 of adjustment shaft 41. Thus, when shaft 41 is rotated while bolt 56 is loosened, the motor support plate 51 will be moved vertically with respect to the base plate 12. On a side of the threaded bore 59 remote from the cylindrical hole 52, the motor support plate 51 has extending through it a further vertical opening which includes a threaded upper portion 62, a lower portion 63 of smaller diameter than the upper portion 62, and an upwardly facing annular step 64 between the portions 62 and 63. A conventional pneumatic motor 67 has a housing 68 with a threaded downward cylindrical projection 69, which is disposed in and threadedly engages the threaded upper portion 62 of the opening through plate 51. The motor 67 has a shaft 71 which is coaxial with and rotates about a vertical axis of rotation 72. A cylindrical actuator part 76 is secured to and extends downwardly from the lower end of the shaft 71 coaxially therewith. A slot 77 opens transversely through the actuator part 76, and extends at an acute angle with respect to the axis of rotation 72.

Referring to FIG. 2, a dovetail coupling 81 includes an upper coupling part 82 and a lower coupling part 83. The upper coupling part 82 is shown in more detail in FIGS. 3 and 4, and includes a cylindrical upper portion 86, a cylindrical central portion 87 coaxial with and of greater diameter than the upper portion 86, and a cylindrical lower portion 88 coaxial with and of greater diameter than the central portion 87. A circumferential groove 91 is provided in the upper cylindrical portion 86 near the upper end thereof. A cylindrical central opening 92 extends vertically and concentrically through the upper coupling part 82.

Figure 4:
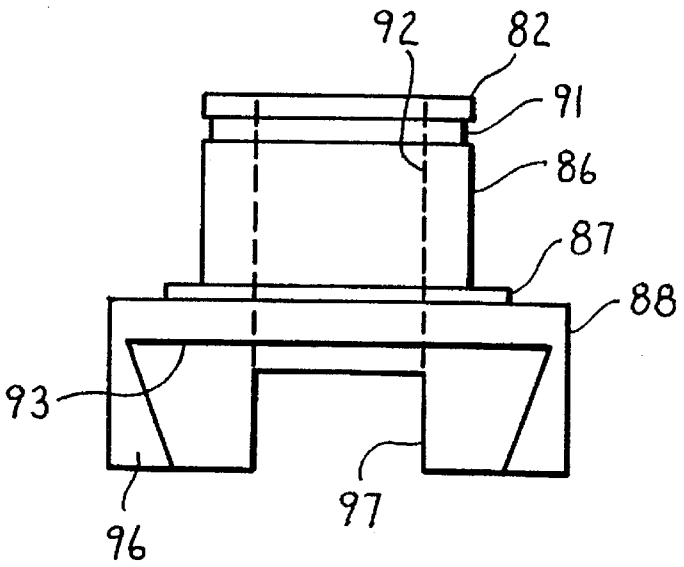
FIG. 4 is a side view of the coupling part of FIG. 3.
Figure 3:
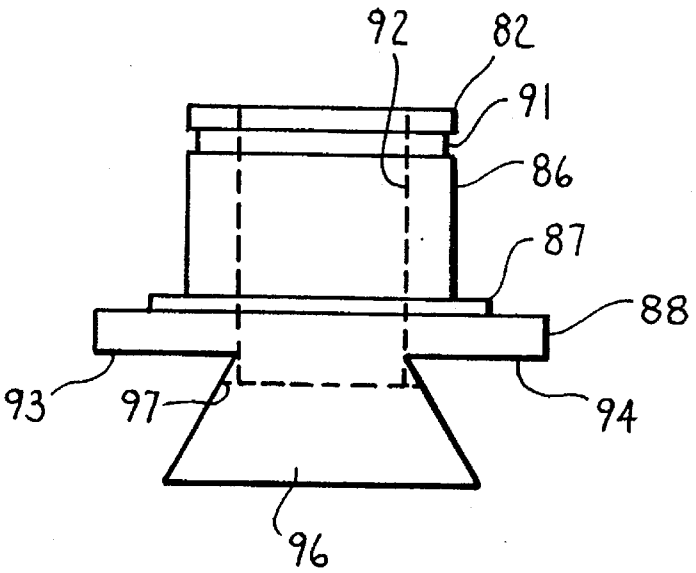
FIG. 3 is a front view of a coupling part which is a component of the embodiment of FIG. 1.

As best seen in FIG. 3, two transversely extending recesses of triangular cross-sectional shape are provided in the lower cylindrical portion 88 on opposite sides; thereof, so as to define two downwardly facing horizontal surfaces 93 and 94 and a transversely extending tongue 96 of trapezoidal cross-sectional shape. As best seen in FIG. 4, a transversely extending groove 97 of rectangular cross-section is provided in the bottom surface of the upper coupling part 82, the groove 97 extending approximately perpendicular to the tongue 96.

As shown in FIG. 2, the upper portion 86 of upper coupling part 82 is disposed snugly within the central opening through the annular inner bearing race 33 of ball bearing 31 with the bottom surface of the inner race 33 disposed against a top surface of the central portion 87, and a snap ring 101 engages the circumferential groove 91 and the top surface of the inner bearing race 33 so that the upper coupling part 82 is supported concentrically with the inner race 33 for rotation therewith. The actuator part 76 extends through the opening 92 without contacting the inwardly facing surfaces thereof, and has its lower end disposed in the oval-shaped recess 119 without contacting the surfaces thereof.

Figure 6:
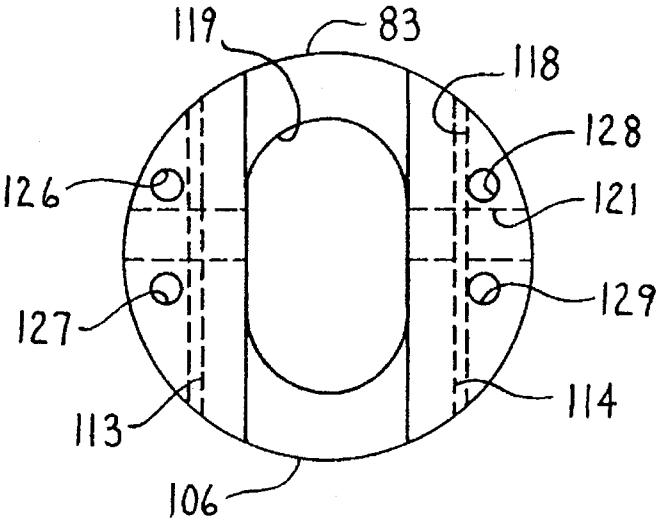
FIG. 6 is a top view of the coupling part of FIG. 5.
Figure 7:
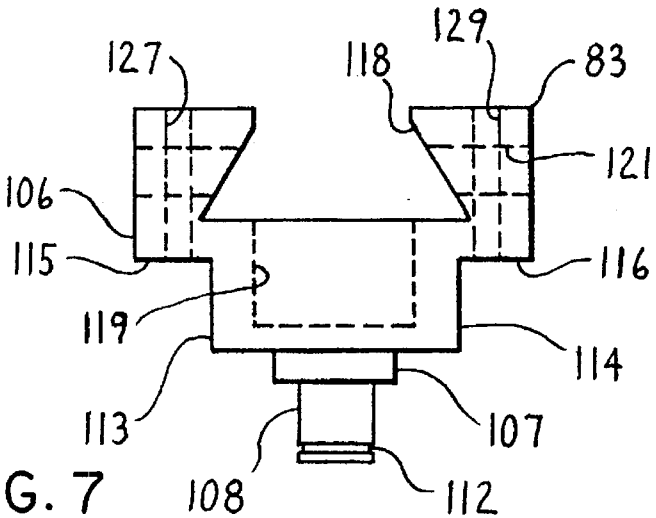
FIG. 7 is a front view of the coupling part of FIG. 5.
Figure 5:
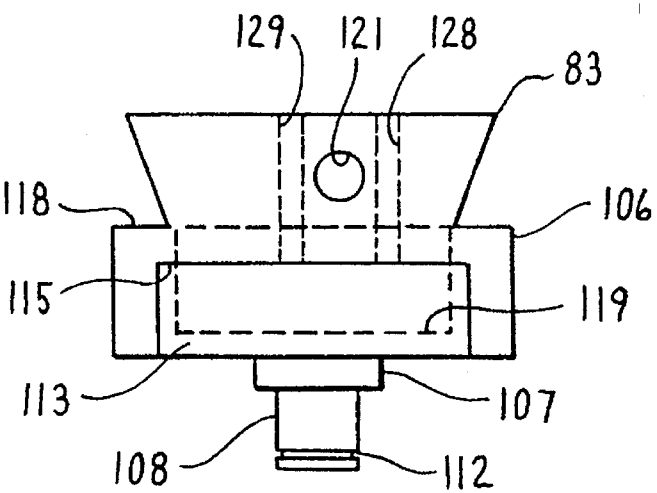
FIG. 5 is a side view of a further coupling part which is a component of the embodiment of FIG. 1.

The lower coupling part 83 of the dovetail coupling 81 is shown in more detail in FIGS. 5–7, and includes a cylindrical upper portion 106, a cylindrical lower portion 107 concentric to and of smaller diameter than the upper portion 106, and a cylindrical stub shaft 108 projecting downwardly from the lower portion 107 concentrically therewith. A circumferential groove 112 is provided in the stub shaft 108 near the lower end thereof.

Two transversely extending recesses of rectangular cross-sectional shape are provided in the cylindrical upper portion 106 on opposite sides thereof so as to define two parallel flat surfaces 113 and 114 which face outwardly in opposite directions, and two downwardly facing horizontal surfaces 115 and 116. A groove 118 of trapezoidal cross-sectional shape opens into the upper end of the upper portion 106 from the top surface thereof, and extends transversely thereacross in a direction parallel to the surfaces 113–116. As best seen in FIG. 6 and 7, an oval-shaped recess 119 opens downwardly into the upper portion 106 from the bottom surface of the groove 118, the recess 119 being elongated in a direction parallel to the groove 118. A transverse bore 121 extends horizontally through the upper portion 106 perpendicular to the groove 118, at a location above the bottom surface of groove 118 and below the top surface of upper portion 106.

Figure 8:
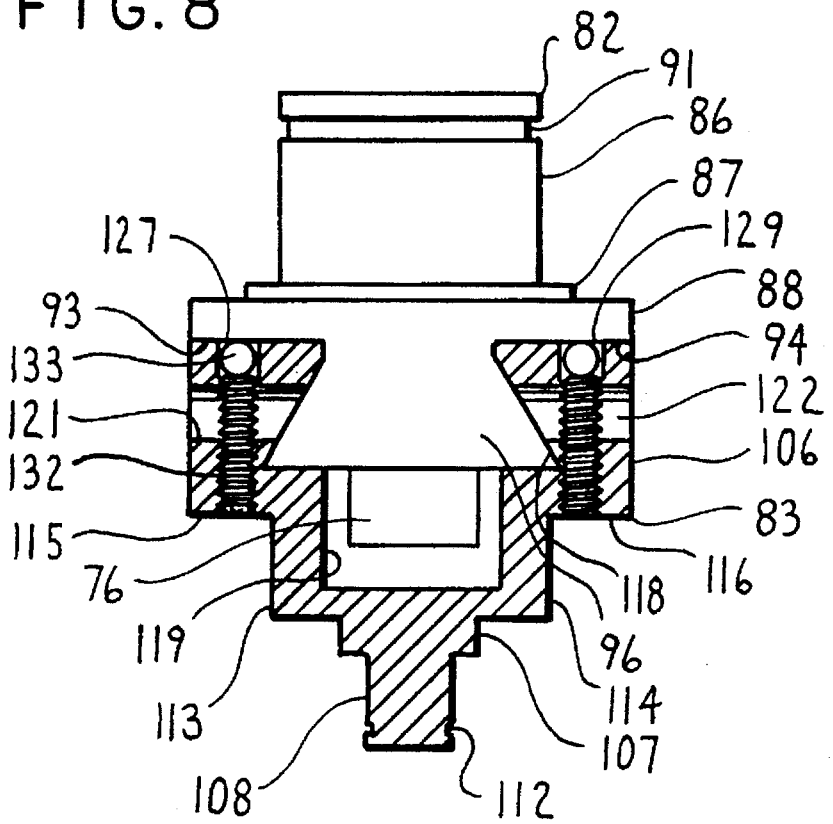
FIG. 8 is a front view, partly in section, of the coupling parts of FIGS. 3–7 in an engaged condition.

As best seen in FIGS. 2 and 8, the transverse groove 118 of trapezoidal shape on the lower coupling part 83 slidably receives the transverse trapezoidal tongue 96 on upper coupling part 82. A cylindrical pin 122 is force fit in the opening 121, and extends through rectangular groove 97 (FIG. 4) in upper coupling part 82 and through the slot 77 in actuator part 76.

Referring again to FIGS. 5–7, the lower coupling part 83 has two threaded openings 126 and 127 extending upwardly from the downwardly facing surface 115 to the top surface of coupling part 83 on opposite sides of the bore 121, and has two similar threaded openings 128 and 129 extending upwardly from the surface 116 to the top surface on opposite sides of bore 121. As shown in FIG. 8, each of the threaded openings 126–129 has in it a screw stud 132 and a respective brass ball 133 disposed above the screw stud 132, the brass balls 133 each engaging one of the downwardly facing horizontal surfaces 93 and 94 on upper coupling part 82. The screw studs 132 are tightened just enough so that the lower coupling part 83 is urged downwardly relative to the upper coupling part 82 so that the inclined surfaces in the groove 112 and on tongue 96 firmly engage each other to eliminate any wobble or play between the coupling parts 82 and 83, while still permitting transverse sliding movement of the lower coupling part 83 relative to the upper coupling part 82 without significant friction.

A ball bearing 141 has an inner race 142, an outer race 143, and a plurality of angularly spaced balls 144 disposed between the races. The inner race 142 has extending through its central opening the cylindrical stub shaft 108, and the upper side of the inner race 142 is disposed against the underside of lower portion 107 of lower coupling part 83. A snap ring 147 engages the groove 112 on stub shaft 108 in order to hold the bearing 141 in place on the stub shaft.

Figure 10:
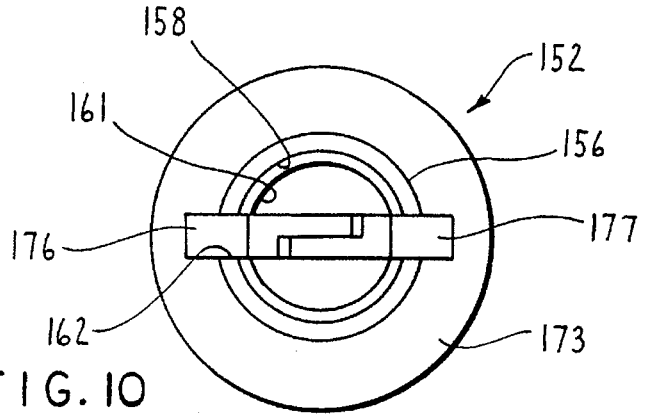
FIG. 10 is a top view of the tool attaching assembly of FIG. 9.
Figure 11:
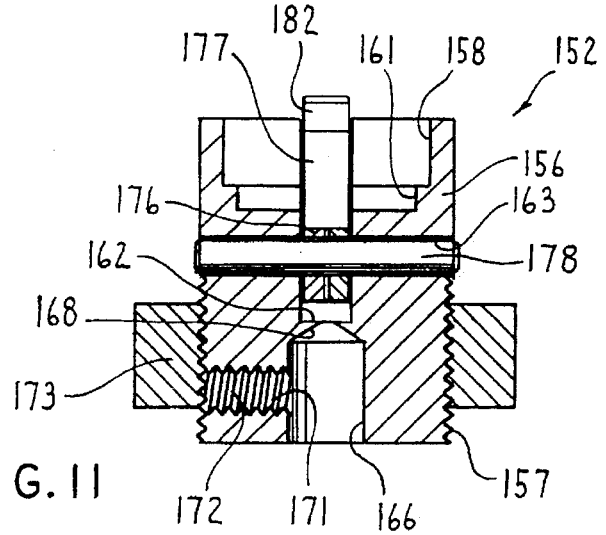
FIG. 11 is a sectional view taken along the line 11—11 in FIG. 9.

Referring to FIG. 2, a tool 151 is supported on the outer race 143 of ball bearing 141 by a tool attaching assembly 152. The tool attaching assembly 152 is shown by itself in FIGS. 9–11, and includes a cylindrical body 156 which has threads 157 at its lower end. A circular recess 158 opens downwardly into the body 156 from the upper end thereof, and a further circular recess 161 of smaller diameter opens downwardly into the body 156 from the bottom of recess 158. The recess 161 has a diameter and depth which are approximately the same as the outside diameter and axial length of the outer race 143 of bearing 141, so that the outer race 143 can be easily and removably inserted into the recess 158 with little or no play (see FIG. 2). The recess 158 is sufficiently deep to receive the lower end of stub shaft 108 and the snap ring 147 without contact therewith, as also depicted in FIG. 2.

A slot 162 opens into the cylindrical body 156 from the upper end thereof and extends transversely thereacross. A cylindrical bore 163 extends transversely through the body 156 in a direction perpendicular to the slot 162, at a location above the bottom of slot 162 and below circular recess 161. A further cylindrical bore 166 extends coaxially upwardly into the cylindrical body 156 from the lower end thereof, and has at its upper end a conical upper portion 168 which opens at its upper end through the bottom surface of the slot 162. A threaded bore 171 extends radially into the body 156 from the outer surface thereof, and opens into the cylindrical bore 166 about midway along its axial length. A screw stud 172 (FIG. 11) is disposed in the threaded bore 171.

Figure 9:
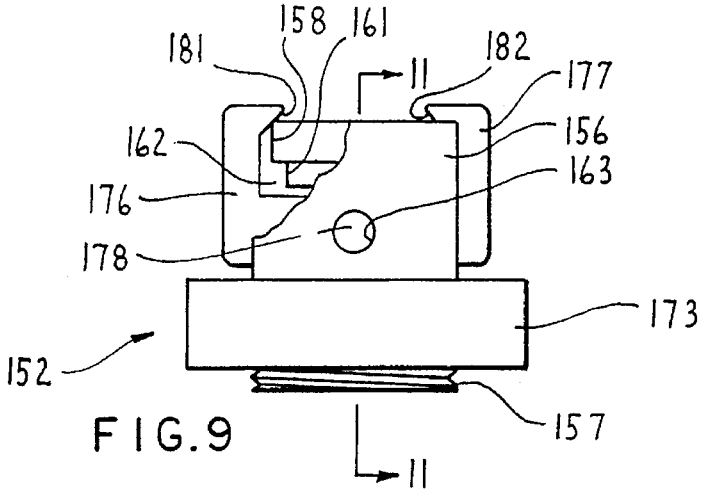
FIG. 9 is a front view of a tool attaching assembly which is a component of the embodiment of FIG. 1.

An annular locking collar 173 has a threaded central opening which engages the threads 157 on the lower portion of cylindrical body 156. Two L-shaped clamp arms 176 and 177 are each disposed partly in the slot 162. Each of the arms 176 and 177 has a horizontal portion with an outer end pivotally supported on a cylindrical pin 178 snugly disposed in the transverse bore 163, and a vertical portion with an inward projection or lip at its upper end, the underside of each lip having a respective inwardly and downwardly facing inclined surface 181 or 182 (FIG. 9).

As evident from FIG. 2, when the locking collar 173 is rotated in a direction which causes it to move upwardly, it pivots the clamp arms 176 and 177 upwardly and inwardly so that the inclined surfaces 181 and 182 engage the upper outer edge of the outer race 143 of bearing 141 so as to fixedly hold the ball bearing 141 in recess 158. Thus, the tool attaching assembly 152 is rigidly releasably coupled to the outer bearing race 143, and can freely rotate with the outer bearing race 143 relative to the inner bearing race 142 and stub shaft 108. By rotating the locking collar 173 so that it moves downwardly, the clamp arms 176 and 177 can pivot outwardly, after which the cylindrical body 156 can be moved downwardly out of engagement with the outer bearing race 143, which permits the tool attaching assembly 152 and tool 151 to be quickly and easily detached from or reattached to the ball bearing 141.

Referring to FIGS. 1 and 2, the tool 151 has a cylindrical shank 186 with a diameter only slightly less than the inside diameter of the bore 166 in the body 156 of the tool attaching assembly 152, the upper end of the shank 186 being removably received in the bore 166 and being securely held there through tightening of the screw stud 172. The centerline 187 of the cylindrical shank 186 represents an axis of rotation for the tool 151, tool attaching assembly 152 and outer bearing race 143 about stub shaft 108, the stub shaft 108 being itself coaxial with respect to the centerline 187. The tool 151 has at the lower end of shank 186 a short cylindrical neck 188 of reduced diameter, and has at the lower end of the neck 188 a tool tip 189. As evident from FIG. 1, the tool tip 189 is square, and thus has four equally angularly spaced abrading points 190 (FIG. 1).

An elongate aluminum extrusion 192, which is itself conventional and not a part of the present invention, is supported for lengthwise movement by an extrusion support and drive mechanism 192. The mechanism 192 is also conventional and not a part of the present invention, and is therefore not disclosed and described in detail. The mechanism 192 effects rapid lengthwise movement of the extrusion 191, the direction of movement being parallel to line 193 in FIG. 1 and perpendicular to the plane of the drawing of FIG. 2.

Referring to FIG. 2, the conventional extrusion 191 includes two C-shaped portions 196 and 197 which are spaced, which open toward each other, and which are connected by a bridge portion 198. The interior of each of the C-shaped portions 196 and 197 is a respective pocket 201 or 202. As shown for C-shaped portion 196, each C-shaped portion has tip or flange portions 203 and 204 with surfaces 206 and 207 at the outer ends that face each other. Further, each C-shaped portion has an inner surface 208 which faces the other C-shaped portion, and has surfaces 211 and 212 which face each other and which extend from the surface 208 to the flange portions 203 and 204. In operation, the abrading points 190 on the tip 189 of tool 151 abrade the inner surface 208 of the pocket 202.

FIGS. 12–15 show a tool support assembly 221 supporting a tool 222, which can be used in place of the tool attaching assembly 152 and tool 151 of FIG. 2. The tool support assembly 221 includes a pair of spaced, parallel support blocks 226 and 227, and a connector bar 228 which extends between ends of the support blocks 226 and 227 and is secured to each by a respective bolt 229. The connector bar 228 projects upwardly above the top surfaces of the support blocks 226 and 227. Bolts 231 and 232 each engage a threaded hole extending downwardly into a respective one of the support blocks 226 and 227 from the upper surface, approximately midway along the length of the upper surface. Each of the bolts 231 and 232 has a head with a radially outwardly projecting wing 233 or 234. Each of the support blocks has, in a corner diagonally opposite from the connector bar 228, a respective rectangular recess 236 or 237.

Two vertically extending extension plates 238 and 239 each have a rectangular recess 241 in the upper edge thereof, and a further rectangular recess 242 in the lower edge thereof. A pair of horizontally spaced and vertically extending spacer plates 243 are provided between the extension plates 238 and 239 at respective sides thereof, the inner edges of the two spacer plates 243 being respectively shown in broken lines at 246 and 247 in FIG. 12. Bolts 248 and 249 each extend through holes in the extension plates 238 and 239 and a respective spacer plate 243, and each engage a threaded opening provided in a respective one of the support blocks 226 and 227.

Figures 12, 13, 14, 15:
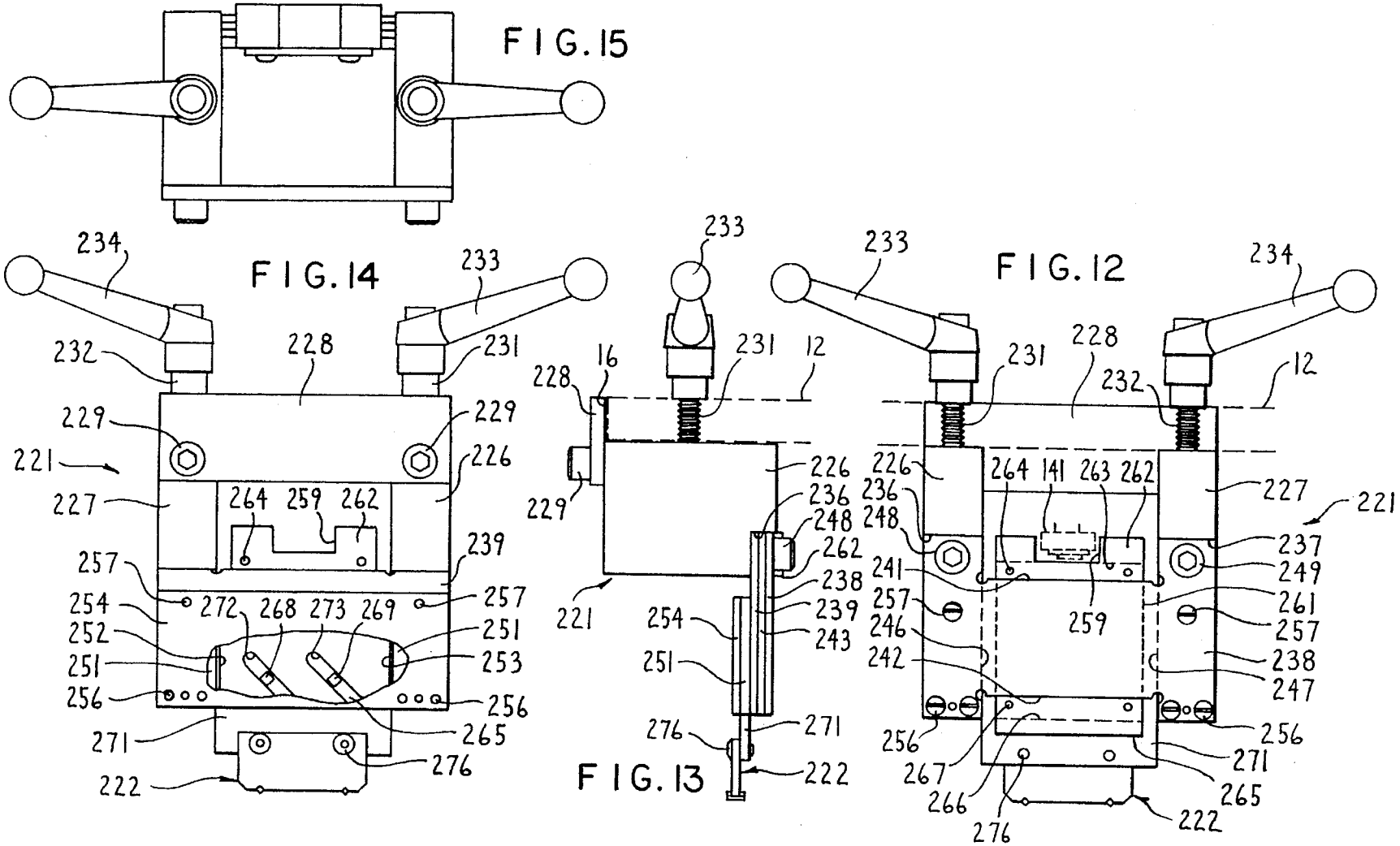
FIG. 12 is a rear view of a tool support assembly and associated tool which can be detachably coupled to the embodiment of FIG. 1 in place of the tool attaching assembly of FIGS. 9–11.
FIG. 13 is a side view of the tool support assembly of FIG. 12.
FIG. 14 is a front view of the tool support assembly of FIG. 12.
FIG. 15 is a top view of the tool support assembly of FIG. 12.

A further pair of horizontally spaced and vertically extending spacer plates 251 (FIG. 14) are provided on the side of extension plate 239 remote from spacer plates 243, and have respective inner edges which are shown at 252 and 253 in FIG. 14. A rectangular outer plate 254 is disposed against the spacer plates 251 on a side thereof remote from the extension plate 239. The lower ends of the extension plates 238 and 239, the spacer plates 243 and 251, and the outer plate 254 are secured to each other by four screws 256. The upper ends of the spacer plates 251 and the outer plate 254 are secured to middle portions of the extension plates 238 and 239 and the spacer plates 243 by two screws 257. The screws 256 and 257 each extend through aligned openings in the plates 238, 243,239 and 251, and each engage a respective threaded hole provided in the plate 254.

Referring to FIG. 12, a vertically extending rectangular drive slide plate 261 is slidably disposed between the extension plates 238 and 239 and between the spacer plates 243, the width of the slide plate 261 being less than the distance between the inner edges 246 and 247 of the spacer plates 243 so as to permit the slide plate 261 to reciprocate horizontally in FIG. 12. A generally rectangular slide drive block 262 has in its underside a lengthwise slot 263 which receives the upper end of drive slide plate 261, the block 262 being secured to the slide plate 261 by a pair of spaced roll pins 264 extending through aligned openings in the block 262 and plate 261. A rectangular recess 259 opens downwardly into the drive block 262 from the upper surface thereof, extends completely through the block 262 in a direction perpendicular to the plane of plate 261, and has a width which is slightly larger than the diameter of the outer race of bearing 141, so that the bearing 141 can be received within the recess 259 as shown in broken lines in FIG. 12.

A cam block 265 has a lengthwise slot which opens downwardly into it from its upper surface and which receives the lower end of slide plate 261, and a pair of spaced roll pins 267 extend through aligned openings in the cam block 265 and slide plate 261 to securely hold these parts together. As shown in FIG. 14, the cam block 265 has two horizontally spaced cam pegs 268 and 269 which are square and which project horizontally outwardly from a side of the cam block 265 nearest the outer plate 254. The square pegs 268 and 269 are oriented so that the sides of each extend at an angle of about 45° with respect to a horizontal reference.

A vertically extending rectangular tool slide plate 271 is vertically slidably disposed between the extension plate 239 and the outer plate 254, and between the spacer plates 251. The width of the tool slide plate 271 is only slightly less than the distance between the inner edges 252 and 253 of the spacer plates 251, so that the slide plate 271 can reciprocate vertically with little or no horizontal play. The slide plate 271 has two parallel, spaced diagonal slots 272 and 273 which each extend at an angle of about 45° with respect to a horizontal reference, and which each have a width slightly greater than the widths of the square cam pegs 268 and 269, each cam peg being slidably received within a respective one of the slots 274 and 273. Thus, as the slide plate 261 reciprocates horizontally with respect to the drive block 262 and cam block 265, the pegs 268 and 269 on cam block 265 cooperate with the slots 272 and 273 to effect vertical reciprocal movement of the slide plate 271.

Figure 17:
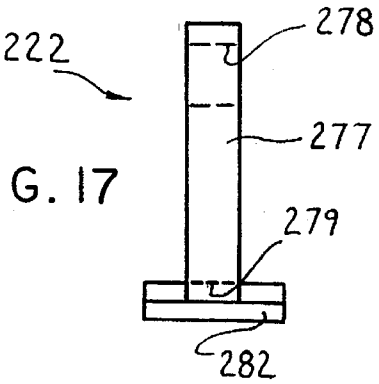
FIG. 17 is an end view of the tool of FIG. 16.
Figure 16:
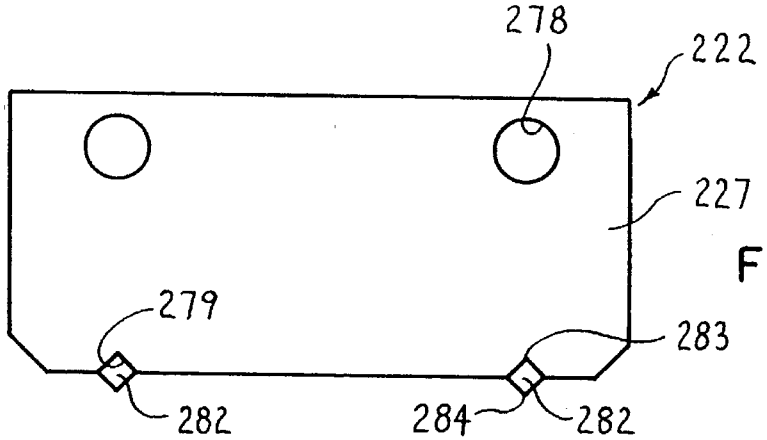
FIG. 16 is a front view of the tool shown in FIG. 12.
Figure 24:
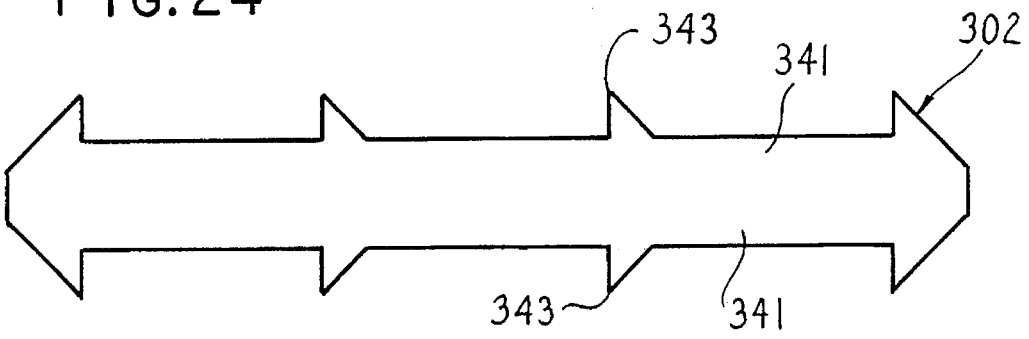
FIG. 24 is a bottom view of the tool of FIG. 22.
Figure 22:
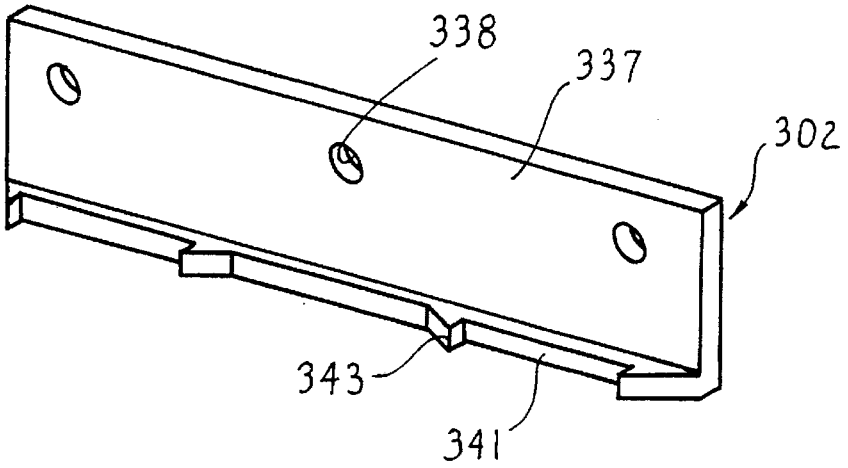
FIG. 22 is a perspective view of the tool depicted in FIG. 19.
Figure 23:
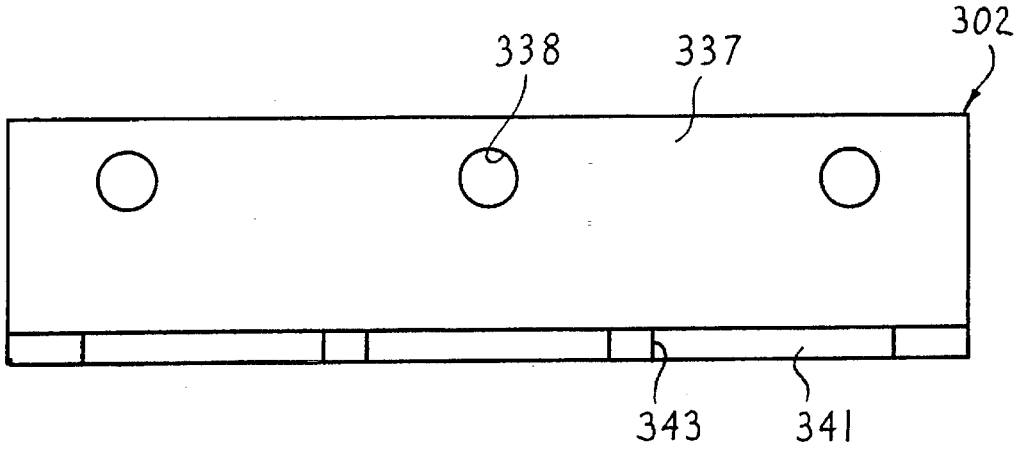
FIG. 23 is a front view of the tool of FIG. 22.
Figure 25:
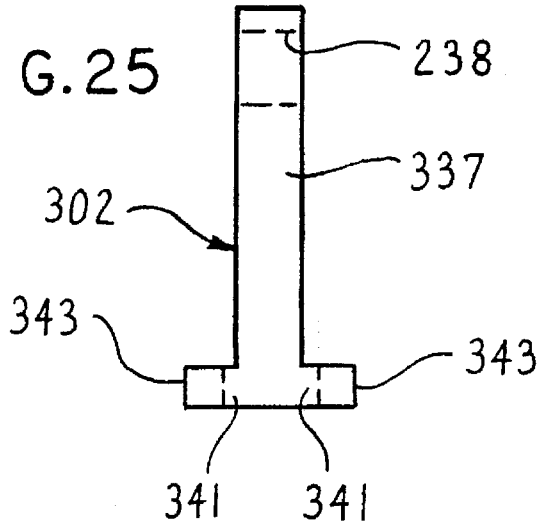
FIG. 25 is an end view of the tool of FIG. 22.

Tool 222 is removably secured to the slide plate 271 by a pair of spaced bolts 276. The tool 222 is shown in more detail in FIGS. 16–17, and includes a vertical tool plate 277 having near its upper edge a pair of spaced transverse holes 278. The bolts 276 (FIG. 14) extend through the holes 278, and engage threaded holes which extend into the slide plate 271 from the edge thereof. Along its bottom edge, the plate 277 has two transversely extending grooves or recesses 279 of triangular cross-section. Two metal bits 282 of square cross-section are each fixedly secured in a respective recess 279, for example by welding or brazing, and each have a length substantially greater than the width of the plate 277 so that, as shown in FIG. 17, the bits 282 each project outwardly from both sides of the tool plate 277. The square cross-section of the bits 282 define an upwardly projecting abrading point 283 and a downwardly projecting abrading point 284 on each end of each bit.

Figure 18:
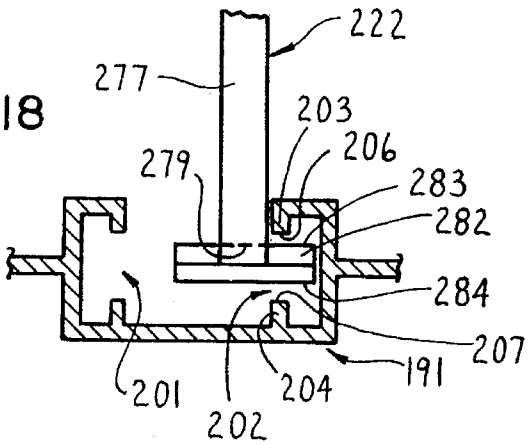
FIG. 18 is an end view of the tool similar to FIG. 17, but showing the tool in an operational position with respect to an extrusion.

FIG. 18 shows the operational position of the tool 222 with respect to the extrusion 191. It will be recognized that, when the tool support assembly 221 of FIGS. 12–15 reciprocates the tool 222 vertically, the abrading points 283 on the two bits 282 abrade the surface 206 on the flange 203 of the moving extrusion, and/or the abrading point 284 abrades the surface 207 on flange 204 of the extrusion.

FIGS. 19–21 show a tool support assembly 301 and tool 302 which are an alternative embodiment of the tool support assembly 221 and tool 222 of FIGS. 12–15. The upper portion of the tool support assembly 301 of FIGS. 19–21 is effectively identical to the tool support assembly 221, and identical parts have been identified with the same reference numerals. The following discussion focuses on the structural differences between these tool support assemblies.

More specifically, in the tool support assembly 301, the lower end of the drive slide plate, 261 is secured by roll pins 307 to a cam block 306, the cam block 306 being similar to the cam block 265 except that it has square cam pegs 308 and 309 (FIGS. 21.) which project downwardly rather than horizontally. Two L-shaped junction blocks 312 and 313 are provided at the lower ends of the extension plates 238 and 239 and spacer plates 243, the screws 256 each passing through the plates 238, 239 and 243 and engaging threaded holes provided in an upwardly projecting leg of a respective junction block 312 or 313.

A bottom plate 316 is disposed against the bottom surfaces of the junction blocks 312 and 313, is secured in place by two bolts 317 and 318 which each extend through a respective opening in the plate 316 and engage a threaded hole in a respective junction block 312 or 313, and has a rectangular recess 321 in one edge thereof. The bottom plate 316 also has two tabs on opposite sides of the recess 321 which are bent downwardly to define spaced, downwardly projecting flanges 322 and 323. A horizontally extending tool slide plate 326 is reciprocally slidably supported on the upper surface of the bottom plate 316 below cam block 306, the width of the slide plate 326 being only slightly less than the distance between the junction blocks 312 and 313 so that the slide plate 326 can reciprocally slide to the left and right as seen in the view of FIG. 20, but is held by the junction blocks 312 and 313 against significant left or right movement in the view of FIG. 19. The slide plate 326 has two parallel diagonal slots 327 and 328 which each slidably receive a respective one of square cam pegs 308 and 309 on the cam block 306. The slots and the sides of the cam pegs extend at an angle of about 45° with respect to the direction of movement of the slide plate 326. Thus, when the drive block 262, slide plate 261 and cam block 326 move leftwardly and rightwardly in FIG. 19, the pegs 308 and 309 cooperate with the slots 327 and 328 to cause the slide plate 326 to reciprocate leftwardly and rightwardly in the view of FIG. 20.

The tool 302 is shown in more detail in FIGS. 22–25. The tool 302 includes a vertically extending tool plate 337 having near its upper edge three transverse through holes 338. The tool 302 is removably secured to the tool slide plate 326 by three bolts 336 (FIG. 20) which each extend through a respective hole 338 in the tool plate 337 and threadedly engage a respective threaded bore extending horizontally into the tool slide plate 326 from an edge thereof. The vertical tool plate 337 has at its lower end two flanges 341 which extend the length thereof and which each project transversely horizontally outwardly, each of the flanges 341 having at spaced locations therealong four triangular barbs which each have an outer end that functions as an abrading point 343.

Figure 26:
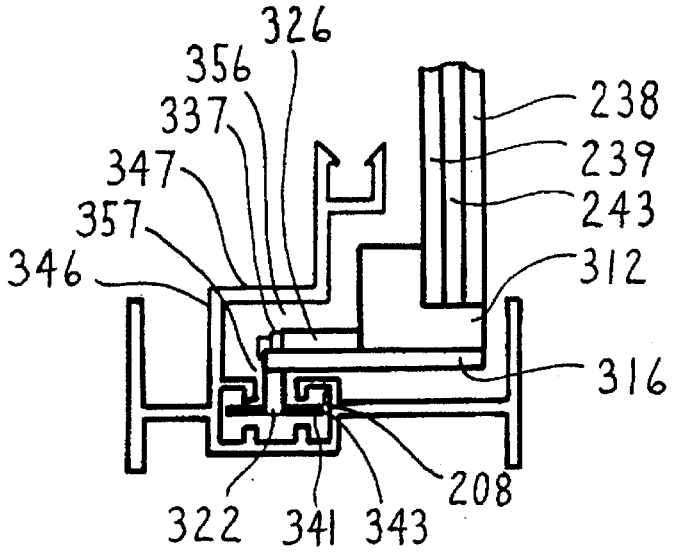
FIG. 26 is a partial side view of the tool support assembly of FIG. 20, shown in an operational position with respect to an aluminum extrusion.

FIG. 26 shows the tool 222 and the lower end of the tool support assembly 221 in an operational position with respect to an extrusion. The extrusion of FIG. 26 includes a wall portion 346 which extends upwardly from one of the C-shaped portions, and a further wall portion 347 which extends horizontally over both C-shaped portions from the upper end of portion 346. The plates 238, 239 and 243 thus extend downwardly into the extrusion, the bottom plate 316 and tool slide plate 326 extend horizontally within a horizontally extending portion 356 of the cavity in the extrusion, and then the vertical tool plate 337 extends downwardly into the region between the C-shaped portions, one or both of the flanges 341 with the abrading points 343 extending into the pocket within a respective C-shaped portion. The plates 326 and 337 thus define an L-shaped support for the abrading points 343, which are the operational portion of the tool.

As the slide plate 326 is reciprocated leftwardly and rightwardly in FIG. 26 relative to elements 238–239, 243, 312 and 316, the tool is reciprocated left and right with the slide plate 326 so that the abrading points 343 on the tool are reciprocated into and out of engagement with the surface 208 in the pocket of at least one of the C-shaped portions, which in turn mechanically roughens the surface 208 on the moving extrusion. It should be evident that the wall portion 347 of the particular extrusion shown in FIG. 26 prevents the use of the tool attaching assembly 152 and tool 151 of FIG. 2 or the tool support assembly 221 and tool 222 of FIG. 12.

OPERATION

To utilize the embodiment of FIGS. 1 and 2, the wing 57 is turned to loosen bolt 56, so that motor support plate 51 can slide vertically with respect to guide pin 19. The knob 46 is then manually turned so that the cooperating threads on shaft 41 and plate 51 raise or lower the plate 51 relative to base plate 12. When the motor support plate 51 is raised relative to base plate 12, the cylindrical actuator part 76 with diagonal slot 77 moves upwardly relative to the dovetail coupling 81 supported on the plate 12 by the bearing 31, thus causing the pin 122 to be shifted leftwardly in FIG. 2, which in turn causes the lower coupling part 83 to move leftwardly in FIG. 2 relative to the upper coupling part 82, as a result of which the tool centerline 187 moves out of alignment with the axis of rotation 72 of the motor shaft while remaining parallel thereto. In other words, as the motor support plate 51 is moved progressively upwardly relative to the base plate 12, the radial distance between (or in other words the degree of eccentricity between) tool centerline 187 and axis of rotation 72 progressively increases. It should be noted that, even though the tool 151 is eccentrically offset from and is arbitally rotated around the axis 72 of the motor shaft by virtue of operation of the motor, the tool 151 can simultaneously and independently rotate about its own centerline 187 through rotation of the outer bearing race 143 relative to the inner bearing race 142.

The knob 46 is manually adjusted until the motor support plate 51 is in a position relative to the base plate 12 in which the abrading points 190 repeatedly strike the surface 208 on the extrusion 191 as the extrusion 191 moves in a lengthwise direction past the tool 151, the abrading points 190 having the effect of denting and gouging the surface 208 so as to mechanically roughen it. The wing 57 is then used to tighten the bolt 56 so that the motor support plate 51 tightly grips the cylindrical guide pin 19 so that the motor support plate 51 is held against vertical movement with respect to the base plate 12. A number of identical extrusions 191 can then be successively and continuously run in a lengthwise direction past the tool 151 to mechanically roughen a surface on each. Further, each extrusion can be reversed and run through the machine 10 in order to mechanically roughen the inner surface of the opposite pocket. Alternatively, and preferably, the tool in tool support arrangement of FIG. 2 is duplicated at two or more adjacent locations so that, as an extrusion moves therepast, one of the tools roughen the surface in one of the pockets, the next tool roughen the surface in the opposite pocket, and so on. It will be recognized that the tool 151 produces a greater degree of surface roughness than sandblasting.

As previously mentioned, the tool 151 and tool attaching assembly 152 of FIG. 2 can be replaced with the tool 222 and tool support assembly 221 of FIG. 12–17. To effect this change, the locking collar 173 in FIG. 2 is turned so that it moves downwardly relative to the body 156, which permits the clamp arms 176 and 177 to pivot downwardly and out of engagement with the bearing 141, after which the body 156 can be moved downwardly and out of engagement with the bearing 141. Then, with reference to FIGS. 1, 12 and 13, the tool support assembly 221 with the tool 222 thereon is moved toward the base plate 12 so that the bolts 231 and 232 each move into a respective slot 13 or 14 in the base plate 12, until the outer edge 16 of tile base plate 12 is disposed against the connector bar 228 with the upper surface of each support block 226 and 227 disposed against the underside of base plate 12, this position of the base plate 12 being indicated in broken lines in FIGS. 12 and 13. The bolts 231 and 232 are then manually tightened so that the base plate 12 is gripped between the support blocks 226 and 227 and the head of each bolt, to fixedly removably attach the support assembly 221 to the base plate 12.

The tool support assembly 221 is designed so that, when it is attached to the base plate 12 in this manner, the bearing 141 on the lower end of coupling assembly 81 (FIG. 2) is disposed in the recess 259 (FIG. 12) of the slide drive block 262. With reference to FIG. 2, when the coupling 81 is set so that the bearing 141 moves eccentrically around the axis 72 of the motor shaft, the eccentric movement of bearing 141 as viewed in FIG. 12 will cause the bearing 141 to alternately engage opposite sides of the slot 259 and move the slide drive block 262 leftwardly and rightwardly in FIG. 12. As the amount of eccentricity in the movement of bearing 141 is progressively increased, the length of the reciprocal stroke of the slide drive block 262 will progressively increase. Since the drive slide plate 261 and cam block 265 are attached to the drive block 262, they reciprocate with it, and thus the square cam pegs 268 and 269 on the cam block 265 cooperate with the diagonal slots 272 and 273 in tool slide plate 271 so as to effect reciprocal vertical movement of the tool slide plate 271 and the tool 222 secured to it. This causes the abrading points 283 on the tool 222 to repeatedly gouge or dent the surface 206 on the moving extrusion, and/or the abrading points 284 to gouge or dent the surface 207. The tool support assembly 221 can be disengaged from the base plate 12 by performing in reverse order the steps described above for attaching it.

The tool support assembly 301 of FIGS. 19–21 is removably attached to the base plate 12 in a manner identical to that described above for the tool support assembly 221. Also, in a similar manner, eccentric movement of the bearing 141 causes the drive block 262, slide plate 261 and cam block 306 to reciprocate through a stroke which varies with the degree of eccentricity of the movement of the bearing 141, the square cam pegs 308 and 309 on the cam block 306 cooperating with the slots 327 and 328 in the tool slide 326 so as to cause tool slide plate 326 to horizontally reciprocate in left and right directions in FIGS. 20 and 26, which in turn causes the abrading points 343 on the tool 302 to repeatedly engage and to gouge or dent at least one surface 208 on the extrusion moving therepast, so as to mechanically roughen that surface. As mentioned above, the tool support assembly 301 is efficient and effective in abrading inner surfaces of pockets in extrusions where a tool of the type shown at 151 in FIGS. 1 and 2 cannot extend directly into the region between the pockets because the extrusion has a portion (as at 347) which extends over the region between the pockets.

Although some specific preferred embodiments have been illustrated and described in detail for illustrative purposes, it will be recognized that there are variations or modifications of the preferred embodiments, including the rearrangement of parts, which lie within the scope of the present invention.

The embodiments of the invention in which an exclusive property or privilege is claimed are defined as follows:

1. A method of mechanically roughening a surface on an elongate extrusion having a central axis extending lengthwise thereof with a tool, including the steps of: effecting a continuous lengthwise movement of said elongate extrusion; orientating a tool so that a centerline thereof extends approximately perpendicular to said central axis; effecting a sequential movement of said tool into and out of engagement with said surface, and causing said tool having first means thereon for engaging and physically roughening said surface on said extrusion to both engage said surface on said continuously moving extrusion and halt any movement of said first means of said tool in a direction parallel to a direction of said lengthwise movement of said extrusion to effect the physically roughening of said surface in response to and as said extrusion moves past said tool.

2. A combination comprising a workpiece and an apparatus, the workpiece comprising an elongate extrusion having a central axis extending lengthwise thereof and having a lengthwise cavity which has therein a surface extending parallel to said central axis; the apparatus comprising a tool disposed in said cavity adjacent said surface; means for effecting a continuous lengthwise movement of said extrusion relative to said tool in a direction parallel to said central axis; and means for reciprocating said tool substantially rectilinearly within said cavity between positions engaging said surface and during said movement of said extrusion relative to said tool and positions spaced from said surface, said tool having a first means for engaging said surface and second means for effecting a halting of any movement of said first means of said tool in said direction parallel to said central axis during engagement of said first means of said tool with said surface so that the continuous movement of said surface relative to said halted first means will cause said surface to be physically roughened by said first means in response to said first means engaging said surface and at the same time that said extrusion is moving with respect thereto.

3. The combination according to claim 2, wherein said cavity in said extrusion has a cross-sectional shape which includes a first portion extending in a first direction approximately perpendicular to said central axis and approximately parallel to said surface, and a second portion contiguous with said first portion extending away from said first portion at a substantial angle to said first portion, said means for reciprocating said tool including an L-shaped support having first and second sections which extend at an angle to each other and which respectively extend through said first and second portions of said cavity, said first means being provided at an end of said first section of said support remote from said second section of said support, and said means for reciprocating said tool effecting movement of said second section of said support approximately in the direction in which said second section extends.

4. The combination according to claim 3, wherein said first means includes a plurality of abrading points projecting from said tool toward said surface and provided at locations spaced along said tool in a direction approximately parallel to said central axis of said extrusion.

5. The combination according to claim 2, wherein said means for reciprocating said tool includes a first movably supported member having said tool supported thereon, a second movably supported member, means for effecting reciprocal movement of said second member, and coupling means responsive to reciprocal movement of said second member for effecting reciprocal movement of said first member.

6. The combination according to claim 5, wherein said coupling means includes a pair of spaced pegs on said second member, and includes a pair of slots in said first member which each slidably receive a respective one of said pegs and which each extend at an angle to the direction of movement of said first member.

7. The combination according to claim 5, wherein said second member has a recess therein, and wherein said means for reciprocating said tool includes a ball bearing supported for rotation about an axis of rotation which is parallel and eccentric to an axis of said ball bearing, said axis of rotation being approximately perpendicular to the directions of movement of said second member, and said ball bearing being disposed in said recess in said second member.

8. The combination according to claim 7, including a base plate and means supporting said ball bearing on said base plate for said rotation about said axis of rotation, and including an assembly which is detachably coupled to said base plate, which has said first and second members movably supported thereon, and which has thereon said coupling means, said bearing being disposed in said recess in said second member when said assembly is detachably coupled to said base plate.

9. A combination comprising a workpiece and an apparatus, the workpiece comprising an elongate extrusion having a central axis extending lengthwise thereof and having a lengthwise cavity with a cross-sectional shape which includes a central portion and first and second pockets which are disposed on opposite sides of said central portion and having elongate slots which each provide communication between said central portion and a respective one of said pockets, said first pocket having therein a surface which extends lengthwise of said extrusion; the apparatus comprising a tool disposed in said cavity and extending from said central portion through one of said slots into said first of said pockets; means for effecting a continuous lengthwise movement of said extrusion relative to said tool in a direction parallel to said central axis; and means for effecting a sequential movement of said tool into and out of engagement with said surface, said tool having first means thereon for engaging said surface and second means for effecting a halting of any movement of said first means of said tool in said direction parallel to said central axis during engagement of said first means of said tool with said surface so that the continuous movement of said surface relative to said halted first means will cause said surface to be physically roughened by said first means as said extrusion moves past said tool and during movement of said first means into engagement with said surface.

10. A combination comprising a workpiece and an apparatus, the workpiece comprising an elongate extrusion having a central axis extending lengthwise thereof and having a surface extending therealong parallel to said central axis; the apparatus comprising a tool disposed adjacent said surface and having a centerline which extends approximately perpendicular to said central axis; means for effecting a continuous lengthwise movement of said extrusion relative to said tool in a direction parallel to said central axis; and means for effecting an orbital rotation of said tool about an axis of rotation which extends approximately parallel to and is spaced radially from said centerline, and means for effecting an engagement of said tool with said surface on said continuously moving extrusion to cause the physically roughening of said surface on said extrusion in response to said extrusion moving past said tool and during said orbital rotation of said tool about said axis of rotation.

11. An apparatus according to claim 10, including means for adjusting the radial distance between said centerline and said axis of rotation.

12. An apparatus according to claim 11, wherein said means for effecting said orbital rotation includes a coupling having a first coupling part which rotates about said axis of rotation and a second coupling part which is supported on said first coupling part, said means for adjusting including said second coupling part being supported for movement relative to said first coupling part in a direction transverse to said axis of rotation.

13. An apparatus according to claim 12, wherein said means for adjusting includes an actuating part which is rotatably driven about said axis of rotation and which has therein a transverse slot extending at an angle to said axis of rotation, and includes said second coupling part having a portion which extends transversely to said axis of rotation and to said direction of transverse movement of said coupling part and which slidably engages said slot, said means for adjusting including means effecting movement of said actuating part relative to said first coupling part in a direction parallel to said axis of rotation.

14. An apparatus according to claim 13, wherein one of said first and second coupling parts has thereon a transversely extending groove of trapezoidal cross-section, and the other of said coupling parts has thereon a transversely extending tongue of trapezoidal cross-section which is slidably disposed in said groove, said tongue sliding within said groove during said relative movement of said first and second coupling parts.

15. An apparatus according to claim 14, wherein one of said first and second coupling parts has a plurality of threaded bores each having therein a metal ball and a screw stud which urges the ball against a surface on the other of said coupling parts which extends approximately perpendicular to said axis of rotation.

16. An apparatus according to claim 13, including a base plate having means for rotatably supporting said first coupling part thereon, and including a motor support plate supported for movement relative to said base plate in directions parallel to said axis of rotation, said motor support plate having thereon a motor with a rotatable motor shaft concentric to said axis of rotation, said actuating part being fixedly supported on said motor shaft, and including means for selectively varying the distance between said motor support plate and said base plate.

17. An apparatus according to claim 10, wherein said means for effecting said orbital rotation includes a bearing having first and second races supported for relative rotation about said centerline of said tool, and a part which is rotatably driven about said axis of rotation, one of said parts of said bearing being supported on said rotatably driven part and the other of said races having said tool supported thereon.

18. An apparatus according to claim 12, wherein said inner and outer races of said bearing are concentric and coaxial to said centerline of said tool wherein the inner race of said bearing is said race supported on said rotating part, and including a tool attaching assembly having means for supporting said tool thereon, having a circular recess which receives the outer race of said bearing, having two clamp arms movable between a release position spaced from said outer race and a clamp position engaging said outer race and holding said outer race in said recess, and including means for releasably maintaining said clamp arms in said clamp position.

19. An apparatus according to claim 18, wherein said attaching assembly includes a cylindrical body having said recess in an upper side thereof, having a slot extending downwardly thereinto from said upper side thereof, having said clamp arms pivotally supported thereon within said slot, and having an annular locking collar engaging external threads provided on said body, rotation of said locking collar in a first direction causing said locking collar to engage said clamp arms and pivot said clamp arms from said release position toward said clamp position.

20. An apparatus according to claim 10, including means supporting said tool for rotation about said centerline independently of rotation of said tool about said axis of rotation.

21. An apparatus according to claim 10, wherein said axis of rotation extends at an angle other than 90° with respect to said surface on said extrusion.

22. An apparatus according to claim 10, wherein said tool has thereon a plurality of projections spaced angularly about and projecting away from said centerline.

23. An apparatus according to claim 10, wherein said extrusion has therein a pocket which is open on one side thereof, which has therein a first surface facing in a direction out of said pocket, and which has second and third surfaces extending from opposite sides of said first surface in a direction toward said open side of said pocket, said tool mechanically roughening said first surface.

* * * * *

UNITED STATES PATENT AND TRADEMARK OFFICE

CERTIFICATE OF CORRECTION

PATENT NO. : 5,577,951

DATED : November 26, 1996

INVENTOR(S) : Leonard J. JABCON, Jr.

It is certified that error appears in the above-indentified patent and that said Letters Patent is hereby corrected as shown below:

Column 15, line 31; change "claim 12" to ---claim 17---.

Signed and Sealed this

Thirteenth Day of May, 1997

Bruce Lehman

*Attest:*

BRUCE LEHMAN

*Attesting Officer*

*Commissioner of Patents and Trademarks*